US010040665B2

(12) United States Patent
Räsänen et al.

(10) Patent No.: US 10,040,665 B2
(45) Date of Patent: Aug. 7, 2018

(54) TENSIONING SYSTEM FOR THE TRACTION BELT OF AN ELEVATOR AND AN ELEVATOR

(71) Applicants: Matti Räsänen, Hyvinkaa (FI); Janne Mikkonen, Jarvenpaa (FI); Esko Aulanko, Kerava (FI); Ilpo Suominen, Kerava (FI); Pentti Alasentie, Espoo (FI); Markku Haapaniemi, Helsinki (FI)

(72) Inventors: Matti Räsänen, Hyvinkaa (FI); Janne Mikkonen, Jarvenpaa (FI); Esko Aulanko, Kerava (FI); Ilpo Suominen, Kerava (FI); Pentti Alasentie, Espoo (FI); Markku Haapaniemi, Helsinki (FI)

(73) Assignee: Kone Corporation, Helsinki (FI)

( * ) Notice: Subject to any disclaimer, the term of this patent is extended or adjusted under 35 U.S.C. 154(b) by 580 days.

(21) Appl. No.: 14/683,842

(22) Filed: Apr. 10, 2015

(65) Prior Publication Data

US 2015/0210507 A1 Jul. 30, 2015

Related U.S. Application Data

(63) Continuation of application No. PCT/FI2013/051020, filed on Oct. 28, 2013.

(30) Foreign Application Priority Data

Oct. 31, 2012 (FI) ..... 20126139

(51) Int. Cl.

| | |
|---|---|
| ***B66B 5/12*** | (2006.01) |
| ***B66B 7/08*** | (2006.01) |
| ***B66B 7/10*** | (2006.01) |

(52) U.S. Cl.
CPC ..... *B66B 5/12* (2013.01); *B66B 7/08* (2013.01); *B66B 7/10* (2013.01)

(58) Field of Classification Search
CPC ..... B66B 5/12; B66B 7/08; B66B 7/10
See application file for complete search history.

(56) References Cited

U.S. PATENT DOCUMENTS

| | | | |
|---|---|---|---|
| 1,901,635 | A | 3/1933 | Dunlop |
| 3,174,585 | A | 3/1965 | Tofanelli |

(Continued)

FOREIGN PATENT DOCUMENTS

| | | | |
|---|---|---|---|
| CN | 2853729 | Y | 1/2007 |
| CN | 102781806 | A | 11/2012 |

(Continued)

OTHER PUBLICATIONS

Extended European Search Report dated Jan. 6, 2016 for EP Application No. 13851887.3.

(Continued)

*Primary Examiner* — Michael A Riegelman
(74) *Attorney, Agent, or Firm* — Harness, Dickey & Pierce, P.L.C.

(57) ABSTRACT

The tensioning system for the traction belt of an elevator is installed or can be installed in connection with the car and/or the counterweight of the elevator for pretensioning at least one traction belt running between these and comprises means for storing energy. In addition to this, the tensioning system is configured to use the energy stored in the means intended for storing energy for pulling in the traction belt in question for returning tension when the tension of the traction belt falls.

Figure 1:
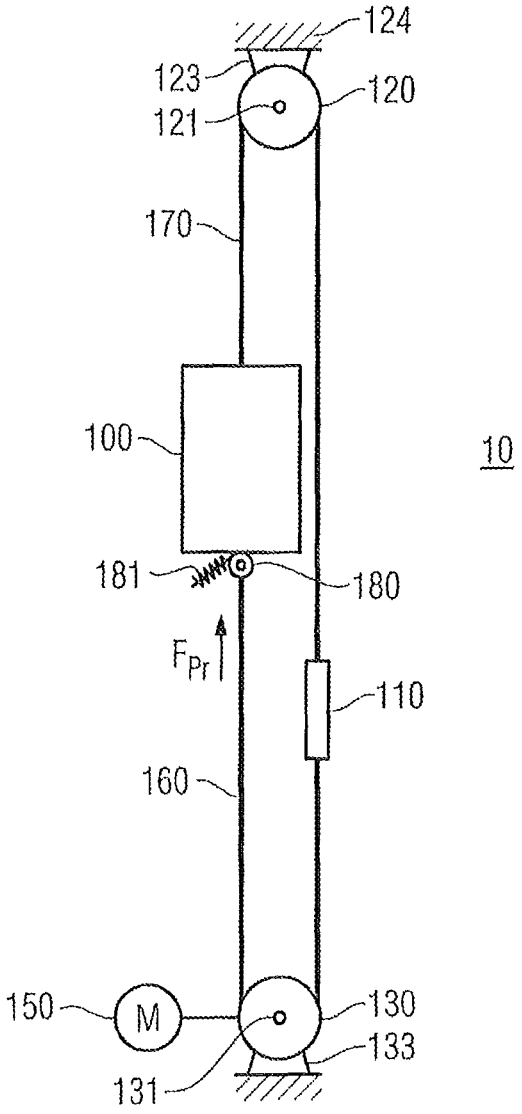

The patent application also contains an independent claim for an elevator.

14 Claims, 4 Drawing Sheets

(56) References Cited

U.S. PATENT DOCUMENTS

| | | | | |
|---|---|---|---|---|
| 5,662,539 | A * | 9/1997 | Schmidtke | F16G 11/12 474/101 |
| 5,861,084 | A * | 1/1999 | Barker | B66B 7/06 187/264 |
| 6,325,179 | B1 * | 12/2001 | Barreiro | B66B 5/0037 187/393 |
| 6,345,549 | B1 * | 2/2002 | Lance | B60N 2/4852 74/500.5 |
| 6,364,063 | B1 * | 4/2002 | Aulanko | B66B 11/008 187/251 |
| 6,966,408 | B2 * | 11/2005 | Sweet | B66B 7/068 187/254 |
| 8,123,002 | B2 * | 2/2012 | Smith | B66B 1/42 187/266 |
| 9,045,312 | B2 * | 6/2015 | Puranen | B66B 5/022 |
| 2008/0060884 | A1 | 3/2008 | Reuter | |
| 2011/0000746 | A1 | 1/2011 | Pelto-Huikko et al. | |
| 2011/0094831 | A1 | 4/2011 | Jezek | |
| 2011/0266097 | A1 | 11/2011 | Valjus et al. | |

FOREIGN PATENT DOCUMENTS

| | | | |
|---|---|---|---|
| JP | 2005212941 | A | 8/2005 |
| JP | 2010168151 | A | 8/2010 |
| JP | 2012051712 | A | 3/2012 |
| WO | WO-2010081935 | A1 | 7/2010 |
| WO | WO-2011107152 | A1 | 9/2011 |
| WO | WO-2012/175807 | A1 | 12/2012 |

OTHER PUBLICATIONS

International Search Report PCT/ISA/210 for International Application No. PCT/FI2013/051020 dated Feb. 14, 2014.
Written Opinion of the International Searching Authority PCT/ISA/237 for International Application No. PCT/FI2013/051020 dated Feb. 14, 2014.
Finnish Search Report for FI20126139 dated Jul. 17, 2013.

* cited by examiner

TENSIONING SYSTEM FOR THE TRACTION BELT OF AN ELEVATOR AND AN ELEVATOR

This application is a continuation of PCT International Application No. PCT/FI2013/051020 which has an International filing date of Oct. 28, 2013, and which claims priority to Finnish patent application number 20126139 filed Oct. 31, 2012, the entire contents of both of which are incorporated herein by reference.

FIELD OF THE INVENTION

The invention relates to the field of elevator technology and more particularly to the implementation of traction beltings to be used in elevators.

TECHNICAL BACKGROUND

The car of an elevator is usually suspended by means of roping or belting e.g. on a counterweight via a pulley assembly fixed to the roof of the elevator. Elongation of the roping or belting in a loading situation of the car of the elevator depends in this case on how far the car of the elevator is from the suspension pulleys. Elongation of the roping or belting in a loading situation is generally at its greatest when the distance of the car of the elevator from the suspension pulleys is at its greatest.

AIM OF THE INVENTION

The inventors are developing an innovative elevator. The aim of the development work is to plan a type of elevator in which the car and the counterweight of the elevator are connected to each other, apart from via a fixed top assembly, also via a fixed bottom pulley assembly. The intention is to implement the connection occurring via the bottom pulley assembly using at least one but preferably two parallel traction belts.

According to the current understanding of the inventors, from the viewpoint of the dynamics of the elevator system it might be advantageous to implement pretensioning of the traction belt running via the bottom pulley assembly. In this way it is endeavored to achieve an entity having the dynamics desired in respect of the dynamic system formed by the car of the elevator, the counterweight, the suspension ropes and the traction belt.

The aim of the present invention is to enable suitable pretensioning of the traction belt running via the bottom pulley assembly between the car and counterweight of an elevator.

BRIEF DESCRIPTION OF THE INVENTION

This aim can be resolved with a tensioning system according to example embodiments for the traction belt of an elevator and with an elevator including the same.

The dependent claims describe advantageous and inventive aspects relating to the tensioning system.

The tensioning system of the invention acts on the tension of the elevator roping, in other words on the tension of the parts of the roping suspending the elevator car and of the parts of the roping moving the elevator, e.g. the traction belt or traction belts.

Advantages of the Invention

The tensioning system for the traction belt of an elevator according to the invention is installed or can be installed in connection with the car and/or the counterweight of the elevator for pretensioning at least one traction belt running between these. The tensioning system comprises means for storing energy. In addition, the tensioning system is configured to use the energy stored in the means intended for storing energy for pulling in the traction belt in question for returning tension when the tension of the traction belt falls.

As a result of the tensioning system a traction belt connecting the car and the counterweight of the elevator running via the bottom pulley can be pretensioned and kept tensioned during the operation of the elevator.

Since the means of the tensioning system for storing energy comprise at least one spring and since the tensioning system comprises a pulley block assembly for pulling in the traction belt a longer distance than the straight-line return distance of the spring, the tensioning system can be implemented to be of smaller size. In this way using the tensioning system also in high-rise buildings is made possible without an excessively large space requirement. In a skyscraper, for example, a traction belt must be pulled in by up to several meters when elongation of the traction belt is in the region of one percent.

Since the tensioning system contains at least one ratchet configured for pulling in a traction belt, which ratchet in its initial position allows rotation of the lock pulley on the ratchet in only one direction, by means of the tensioning system, e.g. in an emergency stop when the tension of the traction belt decreases, the traction belt can be tightened back to the desired tension and thus the desired tension can be maintained.

Since in the tensioning system the lock pulley on the at least one ratchet is fitted to the tooth patterning of the traction belt, slipping of traction belt on the lock pulley can be better avoided.

Since in the tensioning system the locking tag of the at least one ratchet is configured to loosen the traction belt when the tension of the traction belt is greater than what is preset, breaking of the traction belt owing to overtensioning can be better avoided. When the traction belt elongates suddenly, e.g. in connection with an emergency stop, the tensioning system pulls in the traction belt. After the emergency stop has concluded the traction belt would remain too tight. By means of a brake arrangement the tension of the traction belt can be returned to correspond to the pretensioning.

The tensioning system according to the invention is most preferably installed in connection with the car of the elevator for connecting the car of the elevator via the traction belt and via a bottom pulley assembly to the counterweight. In this case great advantage is achieved from the tensioning system when the tensioning system is pretensioned.

At least one tensioning system of the type described above is installed in connection with the car and/or counterweight of an elevator according to the invention for connecting the car and the counterweight to each other by means of a traction belt running via a pretensioned or pretensionable bottom pulley assembly.

In some inventive solutions, in which there is a part of the elevator roping leaving upwards from the elevator car and a second part of the elevator roping that leaves downwards from the elevator car, and in which the elevator roping is pretensioned, a stiff suspension of the elevator car is achieved as an advantage. Owing to this type of stiff suspension the movement of the elevator car, e.g. when people move into the elevator car or out of the elevator car, is smaller than if the roping were not pretensioned. Preferably pretensioning brings about tension in the part of the roping downwards from the elevator car, the effect of which in terms of its magnitude as a force pulling the car downwards is at least half the weight of the nominal load permitted for the elevator car. Even more preferably pretensioning brings about tension in the part of the roping downwards from the elevator car, the effect of which in terms of its magnitude as a force pulling the car downwards is the weight of the nominal load permitted for the elevator car or a weight greater than that. A larger force effect can reasonably be 125%-250% of the weight of the nominal load of the elevator car. Dimensioning to be very much larger than this is not sensible, because from the viewpoint of adequate operation of the elevator it is not sensible to overdimension the roping or structures.

In some inventive solutions, in which there are parts of the elevator roping upwards and downwards from the elevator car and the elevator roping is pretensioned, the means of the pretensioning system are preferably configured to shorten the elevator roping when the rope tension in the part leaving downwards from the elevator car decreases to below a set magnitude or disappears completely.

In some inventive solutions, in which there are parts of the elevator roping upwards and downwards from the elevator car and the elevator roping is pretensioned, the means of the pretensioning system are preferably configured to lengthen the elevator roping when the rope tension in the part leaving downwards from the elevator car increases to above a set magnitude.

LIST OF DRAWINGS

Figure 2:
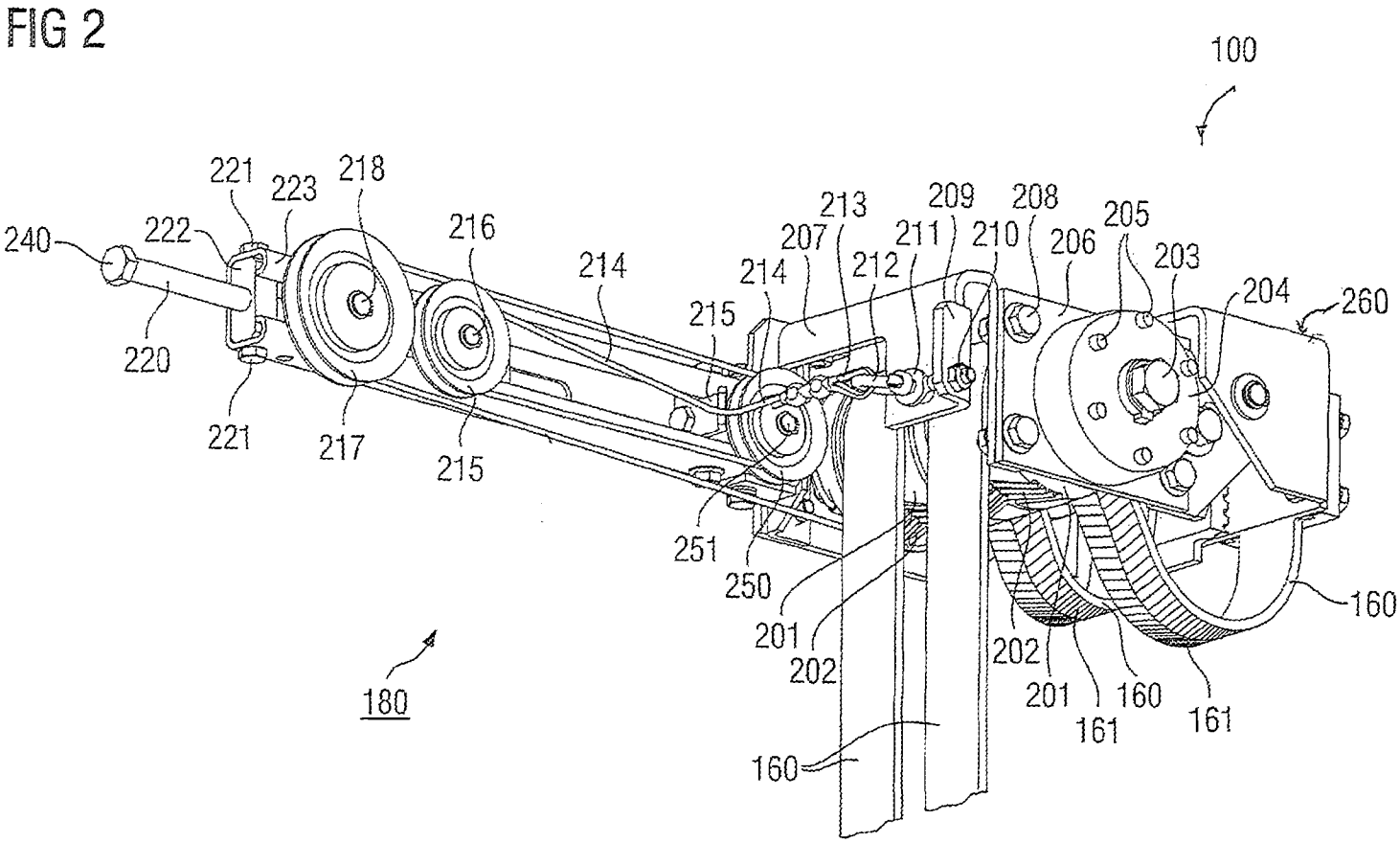
Figure 3:
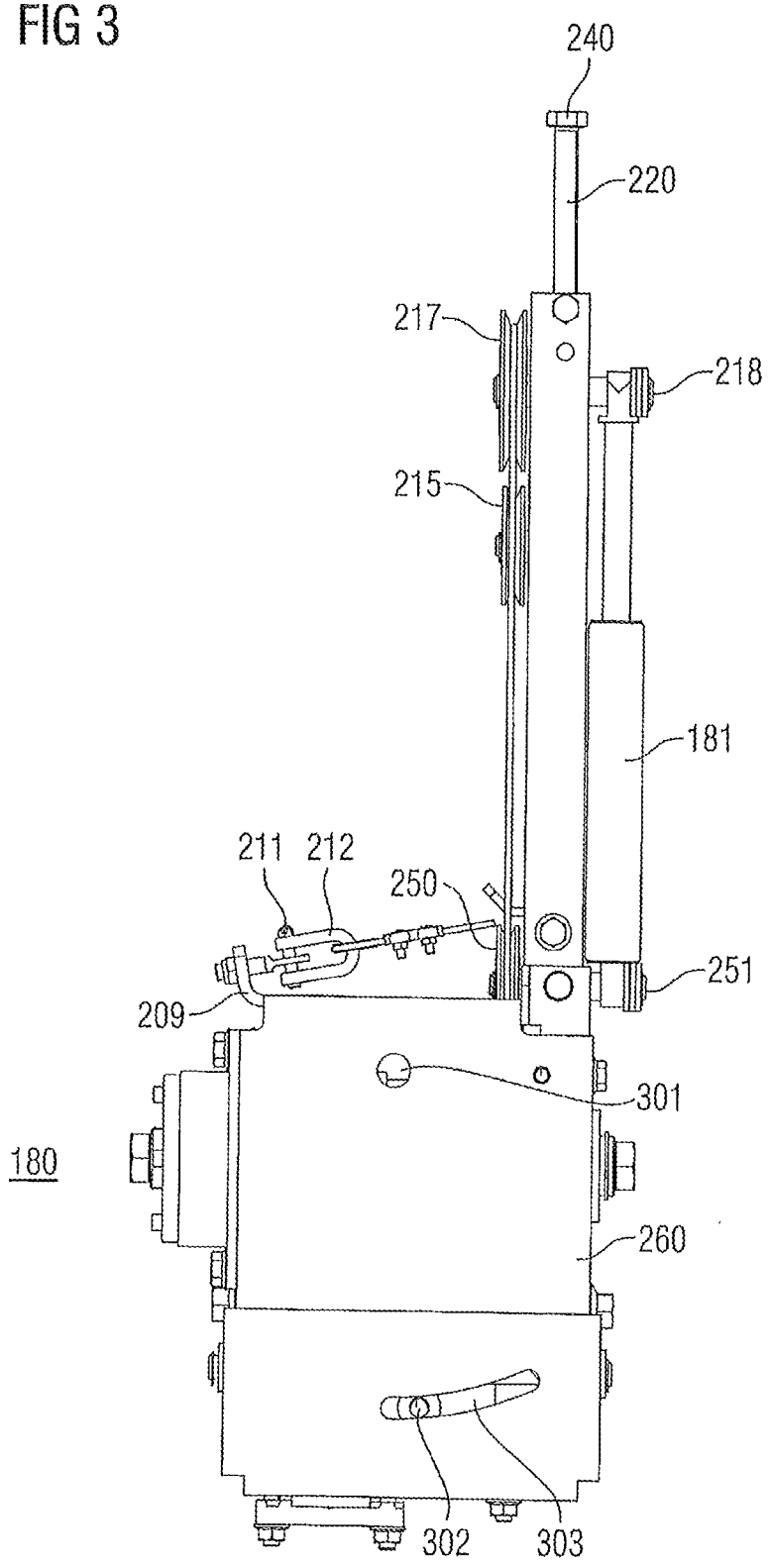

The tensioning system for the traction belt and the elevator are presented in the following in more detail by the aid of the embodiments presented in FIGS. 1-4. Of the drawings FIG. 1 presents a schematic drawing of an elevator, wherein at least one tensioning system is installed in connection with the car of an elevator for connecting the car and the counterweight to each other by means of a traction belt running via a pretensioned or pretensionable bottom pulley assembly;

FIG. 2 presents a perspective view of the tensioning system;

FIG. 3 presents a top view of the tensioning system; and

Figure 4:
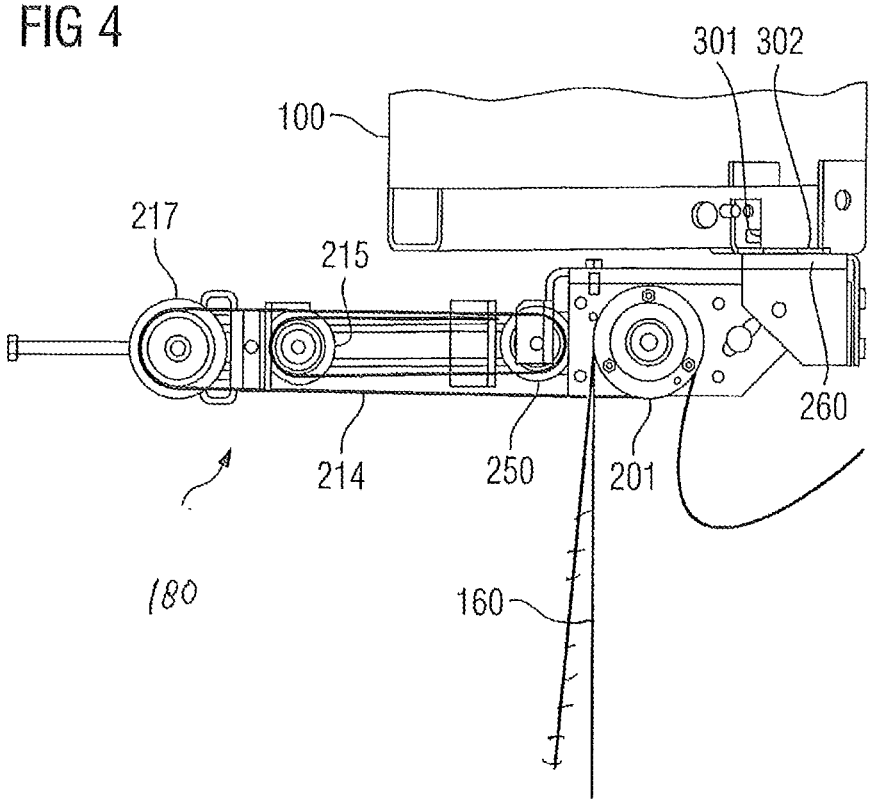

FIG. 4 presents the connection of the tensioning system to the car of the elevator.

The same reference numbers refer to the same parts in all the FIGS.

DETAILED DESCRIPTION OF THE INVENTION

FIG. 1 presents an elevator 10. The car 100 of the elevator 10 is suspended by means of roping 170 from the top pulley assembly (pulley 120 and suspension shaft 121) to be installed on the roof 124. A roof fixing 123 is between the top pulley assembly and the roof 124.

At the one end of the roping 170 is a counterweight 110. The roping 170 is implemented e.g. as at least one but preferably two or more steel wire ropes.

The car 100 and counterweight 110 are connected to each other also via a bottom pulley assembly (pulley 130 and suspension shaft 131). For this purpose one or preferably more traction belts 160 running via the bottom pulley assembly are used.

The machine of the elevator 10 comprises a motor 150, which moves the car 10 reciprocally by means of traction means arranged in connection with the bottom pulley assembly. The traction means are configured to grip into the formed teeth 161 of the traction belt 160. In this way slipping of the traction belt 160 on the traction means is better avoided.

The bottom pulley assembly is fixed to the floor e.g. by means of a floor fixing 133.

At least one but preferably all the traction belts 160 are tensioned by pretensioning them by using at least one tensioning system 180 in such a way that pretensioning $F_{Pr}$ will come between the counterweight 110 and the car 100.

FIG. 2 presents a tensioning system 180. The spring 181 in the tensioning system 180 is more visible in FIG. 3.

The tensioning system 180 is composed of three main components:

- a certain type of free-clutch bearing (diode bearing), which allows rotation in only one direction for tensioning the traction belt 160;
- a means intended for storing energy, such as e.g. a spring 181, which tightens the traction belt 160 if a smaller tensioning force is exerted on the traction belt 160 than the preset tension $F_{Pr}$;
- a brake, which loosens the traction belt 160 if a greater tensioning force is exerted on the traction belt 160 than the preset tension $F_{Pr}$.

The tensioning system 180 comprises means for storing energy. In the case of FIG. 2 the spring 181 is a gas spring, but another type of spring can be used.

The tensioning system 180 is configured to use the energy stored in the means 219, 181 intended for storing energy for pulling in the traction belt 160 in question for returning tension when the tension of the traction belt 160 falls.

The tensioning system 180 additionally comprises also a pulley block assembly for pulling in the traction belt 160 a longer distance than the straight-line return distance of the spring 181. The pulley block assembly comprises pulleys 215, 217, 250, which are fixed to the tensioning system 180 by means of shafts 216, 218, 251.

The tightness of the spring 181 of the tensioning system 180 is adjusted by rotating the bolt 220 at the head 240. The bolt 220 travels through the end piece 222. The end piece 222 is anchored into its position on the arm 223 of the tensioning system 180 by means of bolts 221. In this way it is possible by tightening the bolt 220 to push the shaft 218 closer to the shaft 251, in which case the spring 181 tightens. At the same time the pulleys 217, 250 of the pulley block assembly come closer to each other.

A wire rope 214 is composed around the pulleys 215, 217, 250 of the pulley block assembly. The wire rope 214 is fixed at one of its ends by means of a karabiner hook 213 to a loop 212, which is bolted by means of a fixing 211 rigidly to the frame 207 of the tensioning system 180. For ensuring the fixing, the fixing 211 is ensured with a bolt 210 fixed into the bracket 209.

The other end of the wire rope 214 is attached to the lock pulley 201 of the ratchet.

The free-clutch bearing is implemented at its simplest in the tensioning system 180 by means of at least one ratchet configured for pulling in the traction belt 160 that is. The ratchet contains a lock pulley 201 and a locking tag 202. The shape of the lock pulley 201 and of the locking tag 202 allows, when the ratchet is in its initial position, rotation of the lock pulley 201 on the ratchet in only one direction. The lock pulley 201 is preferably fitted into the formed teeth 161 of the tooth patterning of the traction belt 160.

The locking tag 202 on the at least one ratchet of the tensioning system 180 is configured to loosen the traction belt 160 if a greater tensioning force is exerted on the traction belt 160 than the preset tension $F_{Pr}$.

The ratchet part 206 is fixed to the frame 207 by means of bolts 208. The ratchet part comprises a shaft 203, which comes through the frame 204. The frame 204 is fixed very robustly with bolts 205 to the ratchet part 206.

By means of the ratchet the traction belt 160 is pretensioned as follows: The shaft 203 is rotated by means of the arm in the release direction of the ratchet. In this case the traction belt 160 pretensions. At the same time the wire rope 214 rotates the pulley, which pushes the spring 181 to be looser.

When the traction belt 160 has been brought to be tensioned to the pretensioning $F_{Pr}$, the spring 181 is tightened to the desired tightness by means of the arm by rotating the bolt 220 at the end 240.

The tensioning system 180 is installed in connection with the car 100 of the elevator 10 in the manner shown in FIGS. 3 and 4, for connecting the car 100 of the elevator via the traction belt 160 and via the bottom pulley assembly 130, 131 to the counterweight 110. For this purpose in the frame of the tensioning system 180, preferably in the top plate 260, is a fixing hole 301 and a fixing thread 302. The fixing thread 302 is preferably in a slot 303, so that the tensioning system can be installed in the desired position with respect to the elevator car 100.

In a normal situation a tensioner of the traction belt 160 is in position. In an emergency stop, for example, when the tensioning force of the strap decreases, the spring force of the spring 181 tightens the belt back to the desired tightness.

When the situation returns back to the normal situation, the tension of the traction belt 160 remains too great, because the diode bearing does not allow the return of the tension situation to the normal level. The brake steps in when the traction belt 160 tensions to be too tight, so that the excessively large forces are not exerted on the whole elevator system as a result of an abnormal disturbance.

The invention must not be regarded as being limited only to the claims below but instead should be understood to include all legal equivalents of said claims and combinations of the embodiments presented.

The invention claimed is:

1. A tensioning system configured to pre-tension a traction belt running between an elevator car and a counterweight of an elevator, the tensioning system comprising:

a potential energy storage device configured to store energy for pulling the traction belt to increase tension when the tension of the traction belt falls, the potential energy storage device including at least one spring; and a pulley block assembly configured to pull in the traction belt a longer distance than a straight-line return distance of the spring, the pulley block assembly including at least two pulleys fixed at opposing ends of the spring via shafts such that the spring is configured to tighten when the shafts are pushed together.

2. The tensioning system according to claim 1, further comprising:

at least one ratchet configured to pull in the traction belt, the ratchet having an initial position which allows rotation of a lock pulley on the ratchet in only one direction.

3. The tensioning system according to claim 2, wherein the lock pulley is fitted to a tooth patterning of the traction belt.

4. The tensioning system according to claim 2, wherein the at least one ratchet includes a locking tag configured to loosen the traction belt when the tension of the traction belt is greater than a threshold.

5. The tensioning system according to claim 1, wherein the tensioning system is configured to connect the elevator car of the elevator to the counterweight via the traction belt and the pulley block assembly.

6. The tensioning system according to claim 5, wherein the traction belt is pretensioned.

7. An elevator comprising:

the elevator car;

the counterweight; and the tensioning system according to claim 1, the tensioning system configured to connect the elevator car and the counterweight via a traction belt running via a pretensioned or pretensionable bottom pulley assembly.

8. The tensioning system according to claim 1, further comprising:

at least one ratchet configured to set an amount of the tension.

9. An elevator comprising:

an elevator car having a top surface and a bottom surface;

a counterweight having a top surface connected to the top surface of the elevator car via a roping looped around a top pulley, and a bottom surface connected to the bottom surface of the elevator car via a traction belt looped around a bottom pulley; and a tension device including a spring, a pulley block, and a ratchet, the spring configured to apply pre-tension to the traction belt by pulling the traction belt around a pulley block assembly, the ratchet configured to set an amount of the pre-tension.

10. The elevator of claim 9, wherein the spring is a gas spring.

11. The elevator of claim 9, wherein the tension device is configured to force the top pulley and the bottom pulley closer together such that the spring tightens.

12. The elevator of claim 9, wherein ratchet is configured to set the pre-tension such that an amount of the pre-tension is at least half of an nominal design load of the elevator.

13. The elevator of claim 9, wherein the tension device is configured to shorten the traction belt when a tension therein decreases.

14. The elevator of claim 9, wherein the tension device is configured to lengthen the traction belt when a tension therein increases.

* * * * *